US010458344B2

(12) United States Patent
Ryan et al.

(10) Patent No.: US 10,458,344 B2
(45) Date of Patent: Oct. 29, 2019

(54) THROTTLE FILTER SYSTEM AND METHOD

(71) Applicants: Joshua J. Ryan, Vermontville, MI (US); Patrick McGraw, East Lansing, MI (US); Johann Eloff, Fort Wayne, IN (US); Murali X. Balasundrum, Fort Wayne, IN (US); Todd Chapman, Olivet, MI (US)

(72) Inventors: Joshua J. Ryan, Vermontville, MI (US); Patrick McGraw, East Lansing, MI (US); Johann Eloff, Fort Wayne, IN (US); Murali X. Balasundrum, Fort Wayne, IN (US); Todd Chapman, Olivet, MI (US)

(73) Assignee: Spartan Motors, Inc., Charlotte, MI (US)

( * ) Notice: Subject to any disclaimer, the term of this patent is extended or adjusted under 35 U.S.C. 154(b) by 0 days.

(21) Appl. No.: 15/787,583

(22) Filed: Oct. 18, 2017

(65) Prior Publication Data

US 2018/0112605 A1 Apr. 26, 2018

Related U.S. Application Data

(60) Provisional application No. 62/411,190, filed on Oct. 21, 2016, provisional application No. 62/435,573, filed on Dec. 16, 2016.

(51) Int. Cl.
*F02D 11/10* (2006.01)
*F02D 11/02* (2006.01)
(Continued)

(52) U.S. Cl.
CPC ..... *F02D 11/105* (2013.01); *F02D 11/02* (2013.01); *F02D 11/106* (2013.01);
(Continued)

(58) Field of Classification Search
CPC ..... F02D 11/105; F02D 11/02; F02D 41/222; F02D 2011/102
(Continued)

(56) References Cited

U.S. PATENT DOCUMENTS 4,976,239 A * 12/1990 Hosaka ..... F02D 11/105 123/399
5,445,125 A * 8/1995 Allen ..... B60K 28/16 123/399

(Continued)

*Primary Examiner* — Mahmoud Gimie
(74) *Attorney, Agent, or Firm* — Reinhart Boerner Van Deuren P.C.

(57) ABSTRACT

A method of filtering a targeted frequency from a pedal input signal is provided. The method includes the steps of sampling the pedal input signal at a sampling frequency, calculating a moving average of the pedal input signal from samples of the pedal input signal, and outputting a filtered signal based on the moving average. A throttle filter system is also provided. The system includes a pedal configured to be actuated to set a desired acceleration of a vehicle, a position sensor configured to convert a position of the pedal into an electrical signal, a vehicle driveline configured to accelerate the vehicle, and a filtering module configured to accept the electrical signal from the position sensor and to filter the electrical signal to remove oscillations at a targeted frequency. In the system, the driveline accelerates the vehicle based on the filtered electrical signal.

21 Claims, 2 Drawing Sheets

(51) Int. Cl.
*F02D 41/22* (2006.01)
*F02D 41/14* (2006.01)

(52) U.S. Cl.
CPC ..... *F02D 11/107* (2013.01); *F02D 41/222* (2013.01); *F02D 2011/102* (2013.01); *F02D 2041/1432* (2013.01); *F02D 2200/602* (2013.01)

(58) Field of Classification Search
USPC ..... 701/110; 123/399
See application file for complete search history.

(56) References Cited

U.S. PATENT DOCUMENTS

2002/0152007 A1* 10/2002 Huber ..... F02D 11/105 701/1
2003/0106527 A1* 6/2003 Farmer ..... F02D 41/222 123/396
2015/0151746 A1* 6/2015 Saito ..... B60W 30/18054 701/99

* cited by examiner

THROTTLE FILTER SYSTEM AND METHOD

CROSS-REFERENCE TO RELATED PATENT APPLICATIONS

This patent application claims the benefit of U.S. Provisional Patent Application No. 62/411,190, filed Oct. 21, 2016, and of U.S. Provisional Patent Application No. 62/435,573, filed Dec. 16, 2016, the entire teachings and disclosures of these applications are incorporated herein by reference thereto.

FIELD OF THE INVENTION

This invention generally relates to a vehicle control systems and methods and, in particular, to an electronic throttle control system and throttle input filtering method for a vehicle.

BACKGROUND OF THE INVENTION

Heavy trucks are known to experience "beaming," which is the oscillation of the vehicle frame at the vehicle frame's resonate frequency in bending. These oscillations can be induced by random inputs from road geometry or tractive forces at the tire contact patch during acceleration or braking. Once the frame is excited, the vibrations impart forces on the driver that lead to throttle pedal oscillations at a similar frequency to the beaming frequency. Because the resulting throttle input (driving) frequency is close to the resonant frequency of the vehicle, the severity (i.e., amplitude) of the vehicle vibrations increases, culminating in an extremely harsh ride.

BRIEF SUMMARY OF THE INVENTION

Embodiments of the present invention provide a method of settling these oscillations when experienced in a heavy truck by filtering the oscillations in the throttle input caused by transmission of the beaming oscillations through the driver's foot. These and other advantages of the invention, as well as additional inventive features, will be apparent from the description of the invention provided herein.

In one aspect, a method of filtering a targeted frequency from a pedal input signal is provided. The method includes the steps of sampling the pedal input signal at a sampling frequency, calculating a moving average of the pedal input signal from samples of the pedal input signal, and outputting a filtered signal based on the moving average.

In embodiments of the method, the targeted frequency corresponds to a beaming frequency of a vehicle frame.

Preferably, the moving average is calculated at the sampling frequency. The sampling frequency can be between 100 and 1000 Hz.

In certain applications, the targeted frequency filtered from the pedal input signal is from 2 to 10 Hz.

In embodiments, the step of outputting the filtered signal further comprises outputting the filtered signal to an engine control module of a vehicle. However, in other embodiments, the step of outputting the filtered signal further comprises outputting the filtered signal to a driveline of a vehicle.

In a particular embodiment, the method further includes the steps of determining a beaming frequency for each vehicle of a sample of vehicles and averaging the beaming frequencies of the vehicles to find the targeted frequency. In another particular embodiment, the method further includes the steps of analyzing the pedal input signal for a resonant frequency having an amplitude above a predetermined threshold and setting the targeted frequency to the resonant frequency if the resonant frequency is detected a requisite number of times.

Additionally, the method can further include the steps of suspending the calculating step if the pedal input signal corresponds to an invalid signal. An invalid signal is either below an idle pedal signal or above a maximum throttle signal. If an invalid signal is found, then the method performs the further step of outputting an unfiltered pedal input signal. Preferably, the suspending step is performed only if the invalid signal is present for at least 50 ms. Furthermore, the method can reengage the calculating step if the pedal input signal is not an invalid signal for at least one period of the targeted frequency.

In another aspect, a throttle filter system is provided. The system includes a pedal configured to be actuated to set a desired acceleration of a vehicle, a position sensor configured to convert a position of the pedal into an electrical signal, a vehicle driveline configured to accelerate the vehicle, and a filtering module configured to accept the electrical signal from the position sensor and to filter the electrical signal to remove oscillations at a targeted frequency. The driveline accelerates the vehicle based on the filtered electrical signal. In such an embodiment, the targeted frequency is a beaming frequency of a vehicle frame. Preferably, the targeted frequency is from 2 to 10 Hz. In certain embodiments, the throttle filter system further includes an engine control module. In such embodiment, the filtering module outputs the filtered electrical signal to the engine control module, and the engine control module outputs the filtered electrical signal to the driveline.

In still another aspect, a control device is provided. The control device is configured to receive a first signal that corresponds to a position of a pedal and to output a second signal that commands a driveline of a vehicle. The control device includes a filtering module configured to sample the first signal at a sampling frequency and output a moving average of the first signal as the second signal such that oscillations of a targeted frequency are filtered from the first signal.

In embodiments of the control device, the targeted frequency is a beaming frequency of a frame of the vehicle. In embodiments, the targeted frequency is from 2 to 10 Hz. Preferably, the filtering module calculates the moving average at the sampling frequency. Additionally, the sampling frequency can be between 100 and 1000 Hz.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Generally, embodiments of a method for filtering out noise in the input of a throttle control system are provided. The throttle is a "drive-by-wire"-type throttle in which the position of a pedal is converted to an electrical signal that causes the driveline of a vehicle to move the vehicle according to the position of the pedal. When a vehicle experiences rough terrain, the vehicle's suspension will cause the frame to vibrate. When this vibration occurs at the natural frequency of the frame (generally, 2-10 Hz), the vibrations are amplified. The vibrations are sent through the driver's foot to the pedal, thereby causing an oscillating force on the pedal. In conventional throttle systems, the oscillation of the pedal produces an oscillating throttle signal, which causes the beaming vibrations to be amplified.

The filtering method disclosed herein is designed to reject the oscillations in the throttle signal caused by the movement of the driver's foot on the pedal. While the disclosed method and system are described in terms of a throttle system for a vehicle, the method and system discussed herein are not limited solely to this context. As will be appreciated by a person having ordinary skill in the art from the disclosure, other contexts and applications are also suitable for embodiments of the disclosed system and method.

Figure 1:
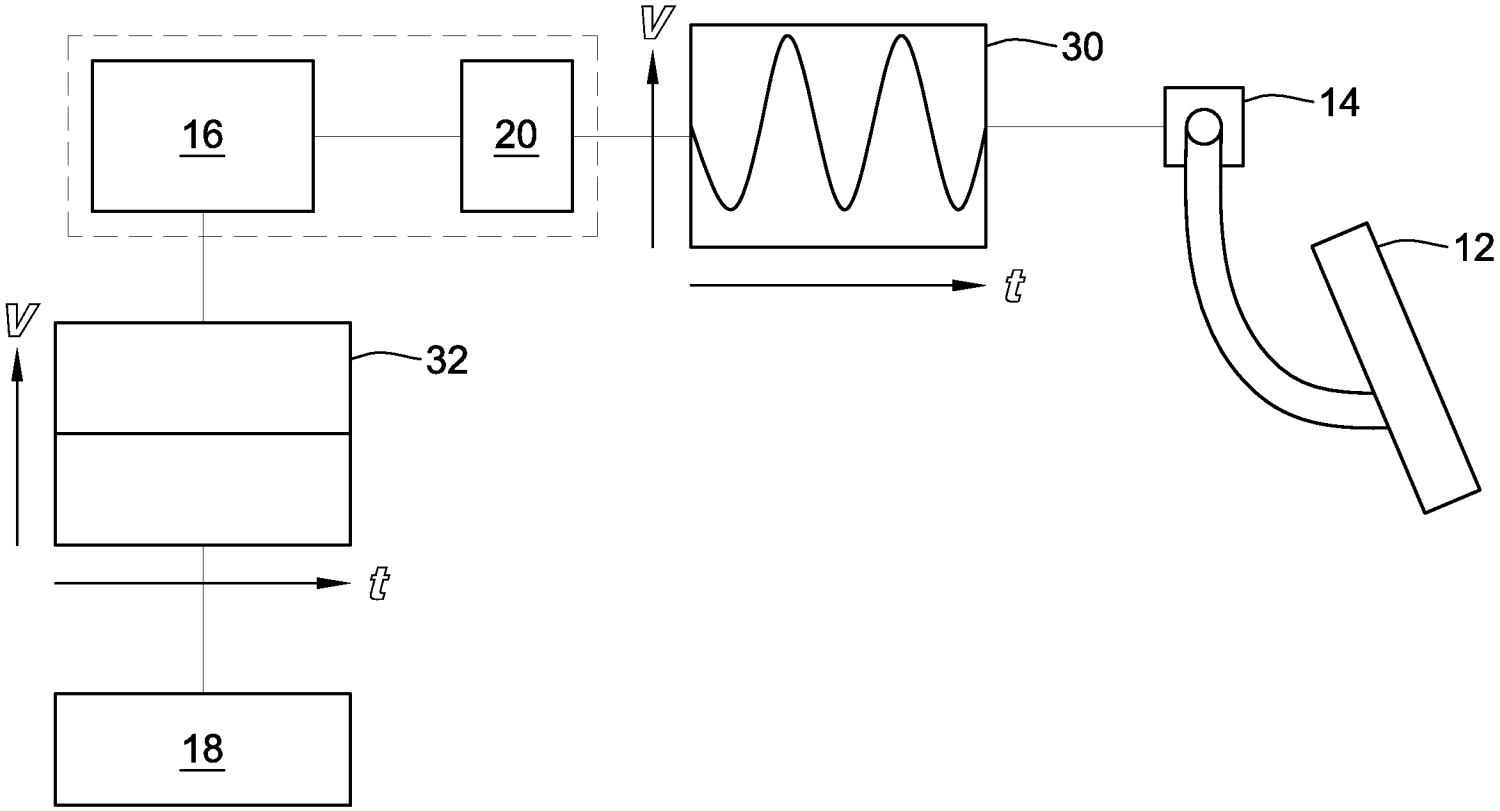
FIG. 1 is a schematic illustration of a vehicle control system configured to perform a throttle filtering method according to an exemplary embodiment.

FIG. 1 provides a schematic illustration of an embodiment of a drive-by-wire throttle system 10 that performs the filtering method. In the depicted embodiment, the throttle system 10 includes a pedal 12 (e.g., a "gas pedal") that the driver of a vehicle actuates to accelerate the vehicle. When the driver presses on the pedal 12, position sensor 14 detects how far the pedal 12 has been depressed. The position sensor 14 sends a signal to the engine control module (ECM) 16. The ECM 16 converts the signal received from the position sensor 14 into a command for the driveline 18 to power or move the vehicle. As discussed above, when a vehicle travels over rough terrain, the suspension bounces, thereby causing vibrations in the vehicle frame. The vibrations in the frame cause the driver's foot to oscillate the pedal 12, which in turn causes an oscillating pedal input signal 30. Absent filtering of the pedal input signal 30, the ECM 16 will command the driveline 18 to follow the pedal input signal 30.

However, as disclosed herein, a filtering module 20 filters out this oscillation in the pedal input signal 30 produced by the vibration of the vehicle frame such that the driveline 18 receives a relatively flat (i.e., non-oscillating) output signal 32. In certain embodiments, the filtering module 20 is separate from the ECM 16 as depicted in FIG. 1. In other words, the filtering module 20 can be, e.g., an after-market device that is plugged into or retrofitted to an existing vehicle. In other embodiments, the filtering module 20 can be part of the ECM 16 as denoted by the dashed line surrounding the filtering module 20 and ECM 16 in FIG. 1. In still further embodiments, the function of the filtering module 20 can be fully subsumed in the function of the ECM 16 such that the ECM 16 filters the pedal input signal 30 to remove oscillations. Thus, reference to the filtering module 20 herein can mean the filtering module 20 by itself, the filtering module 20 in combination with the ECM 16, or the function of the filtering module 20 as performed by the ECM 16.

In an embodiment, the filtering module 20 filters the pedal input signal 30 by tailoring the filtering to a specific frequency, i.e., a targeted frequency $f_{target}$. For instance, the filtering can be tailored such that the targeted frequency $f_{target}$ is the beaming frequency of the vehicle frame. Generally, the beaming frequency is from 2-10 Hz. In a specific embodiment, the filtering module 20 filters the pedal input signal 30 by calculating a moving average of the pedal input signal 30. In such embodiments, the moving average can be a simplistic moving average, weighted moving average, an exponential moving average, etc.

The moving average is calculated first by selecting a sampling frequency $f_{samp}$. The sampling frequency $f_{samp}$ refers to the number of samples n that the filtering module 20 takes of the pedal input signal 30 over a predetermined period of time. In embodiments, the sampling frequency $f_{samp}$ is between 100 Hz and 1000 Hz with 1000 Hz being a preferred sampling frequency $f_{samp}$. The predetermined period of time over which the samples are taken is preferably equivalent to one period of the target frequency $f_{target}$. In such an embodiment, the number of samples n taken during this time period will be given by the relationship $n=f_{samp}/f_{target}$. The moving average can be calculated using the following equation:

$$y_1 = \frac{x_1 + x_2 + \ldots + x_n}{n} \tag{1}$$

where $x_{1,2,\ldots,n}$ are sampled inputs from the pedal and $y_1$ is the output of the filtering module 20. Preferably, the moving average is calculated once over a complete period of the targeted frequency $f_{target}$. For instance, if the targeted frequency $f_{target}$ is 9 Hz, the moving average is calculated over 0.111 seconds. If the sampling frequency $f_{samp}$ is 1000 Hz, then a sample will be taken every 1 ms, and the moving average will be calculated based on 111 samples. For each new sample taken, the moving average is recalculated based on the new sample plus the previous 110 samples (i.e., new sample+110 previous samples=111 total samples for calculation of the moving average). Because a new moving average is calculated for each new sample taken, the moving average is therefore calculated at the sampling frequency $f_{samp}$. Because the pedal input signal 30 oscillates above and below the driver's desired input level, taking samples over the course of an entire period of the targeted frequency $f_{target}$ and then calculating the moving average based on those samples will provide an output signal 32 closer to the driver's desired level.

While the beaming frequency is typically between 2-10 Hz, preferably a specific targeted frequency $f_{target}$ is determined for a specific vehicle model and/or for each specific vehicle. This targeted frequency $f_{target}$ can be found in multiple ways. For instance, the targeted frequency $f_{target}$ could be set at the average resonating frequency determined by sampling multiple vehicles of the same make and model. Advantageously, this would require no modification of the filtering characteristics after installation of the filtering module 20. Alternatively, the targeted frequency $f_{target}$ could be calculated using test equipment such that the targeted frequency $f_{target}$ is specific to the vehicle tested. The targeted frequency $f_{target}$ would then be programmed into a filter module 20 that has already been installed in the tested vehicle.

In another embodiment, the targeted frequency $f_{target}$ is calculated automatically directly from the input from the pedal 12 or from a separate accelerometer mounted on the vehicle frame or near the pedal 12. In such an embodiment, the filtering module 20 analyzes the pedal input signal 30 for a resonant frequency with an amplitude above a predetermined threshold. After detecting a requisite number of such events, the filtering module 20 would then set the targeted frequency $f_{target}$ at the detected resonant frequency.

In embodiments, multiple pieces of fuzzy logic can be utilized to comply with regulatory and/or supplier requirements, such as Cummins AEB 15.67. One particular requirement defined in Cummins AEB 15.67 is whether a pedal signal is valid. Generally, an invalid signal is produced if it is below an idle pedal position value (i.e., pedal 12 not depressed) or above the maximum throttle position value (i.e., pedal 12 fully depressed). In order to prevent any instantaneous behaviors from being passed through, the filtering module 20 output changes to reflect these two conditions. In one exemplary embodiment, the filtering module 20 outputs the value from the pedal 12 at a 1:1 ratio, i.e., the output signal 32 follows directly the pedal input signal 30. Once the electronic signal from the pedal reenters the normal operating range, the throttle signal filter is reactivated.

Figure 2:
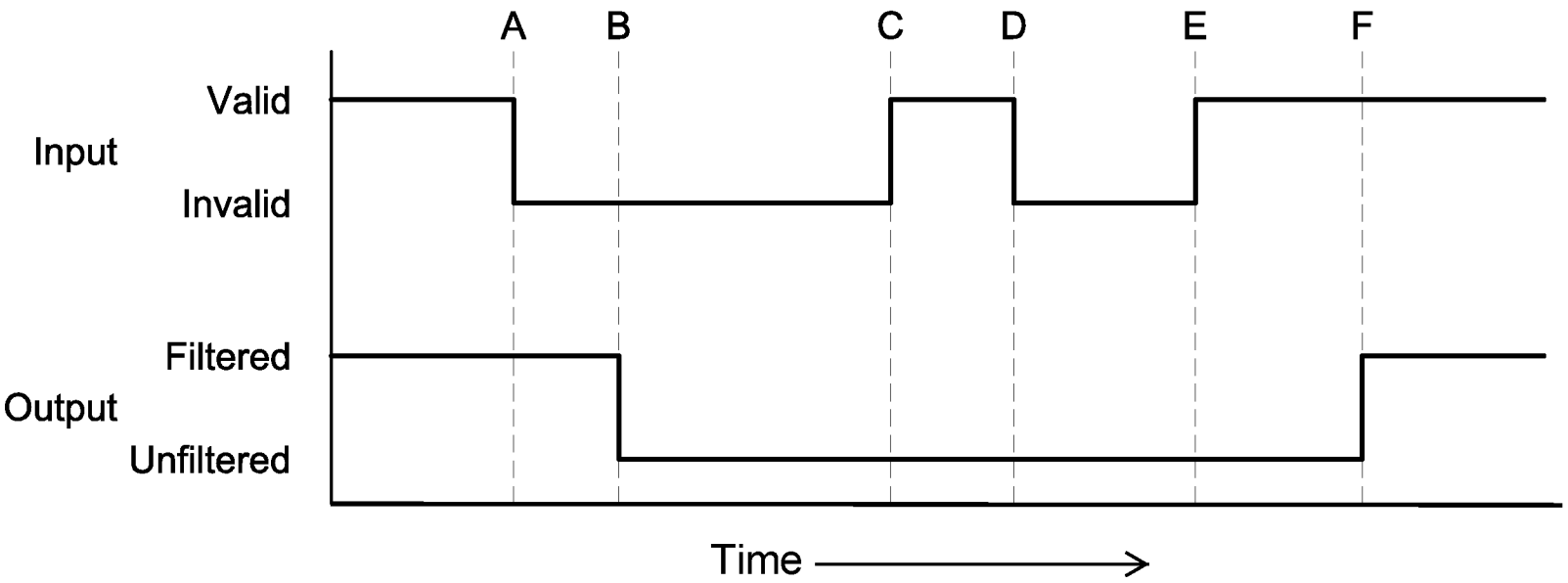
FIG. 2 depicts a state diagram for the filtering module's response to an invalid pedal signal according to an exemplary embodiment.

FIG. 2 depicts a state diagram for the filtering module's response to an invalid pedal signal. At time A, the pedal input becomes invalid (i.e., above or below the operating range). The filtering module will continue to operate normally until the pedal input has stayed at this point for a required duration, such as 50 to 70 ms (milliseconds). At time B, the pedal input has stayed invalid long enough that the filtering module recognizes the input as a short and ceases filtering the output. The filtering module then clears out all the samples it has and simply relays the unfiltered pedal input to the engine so it can log a fault. The filtering module will remain in this state until the input changes. At time C, the input to the filter returns to being a valid value. The filtering module begins recording the sampled values to fill the array for the filtering calculation. As discussed above, the array preferably includes samples collected over a full period of the target frequency. The filtering module will continue to simply provide the unfiltered output until the array is full. At time D, the input has once again returned to being an invalid value. The logic performed at time B is once again performed, i.e., the filter clears the filtering array and continues providing the unfiltered value until the signal stays valid for the required amount of time. Notably, the time between C and D is not long enough to fill the sample array, and therefore, the output does not switch back to a filtered output. At time E, the pedal input once again becomes valid, so the filter begins filling the array of samples. At time F, the pedal input has been valid long enough for the filtering module to finish filling its sample array, and thus, the filtering module begins providing its filtered output again.

In another exemplary embodiment, the filtering module resets prior values in the moving average. In doing so, the filtering module keeps all values calculated within a predetermined amount of time and fills in the rest with the current pedal value. After resetting the values, the filtering module runs the filtering method as normal. As in the prior case, when the pedal input signal exits the triggering region (i.e., idle pedal or maximum throttle position ranges), the filtering method continues to run normally.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A method of filtering a targeted frequency from a pedal input signal, the method comprising the steps of:

sampling the pedal input signal at a sampling frequency;

calculating a moving average of the pedal input signal from samples of the pedal input signal; and outputting a filtered signal based on the moving average.

2. The method of claim 1, wherein the targeted frequency corresponds to a beaming frequency of a vehicle frame.

3. The method of claim 1, wherein the moving average is calculated at the sampling frequency.

4. The method of claim 1, wherein the sampling frequency is between 100 and 1000 Hz.

5. The method of claim 1, wherein the targeted frequency filtered from the pedal input signal is from 2 to 10 Hz.

6. The method of claim 1, wherein the step of outputting the filtered signal further comprises outputting the filtered signal to an engine control module of a vehicle.

7. The method of claim 1, wherein the step of outputting the filtered signal further comprises outputting the filtered signal to a driveline of a vehicle.

8. A method of filtering a targeted frequency from a pedal input signal, the method comprising the steps of:

sampling the pedal input signal at a sampling frequency;

calculating a moving average of the pedal input signal from samples of the pedal input signal; and outputting a filtered signal based on the moving average;

further comprising the steps of:

determining a beaming frequency for each vehicle of a sample of vehicles; and averaging the beaming frequencies of the vehicles to find the targeted frequency.

9. A method of filtering a targeted frequency from a pedal input signal, the method comprising the steps of:

sampling the pedal input signal at a sampling frequency;

calculating a moving average of the pedal input signal from samples of the pedal input signal; and outputting a filtered signal based on the moving average;

further comprising the steps of:

analyzing the pedal input signal for a resonant frequency having an amplitude above a predetermined threshold; and setting the targeted frequency to the resonant frequency if the resonant frequency is detected a requisite number of times.

10. A method of filtering a targeted frequency from a pedal input signal, the method comprising the steps of:

sampling the pedal input signal at a sampling frequency;

calculating a moving average of the pedal input signal from samples of the pedal input signal; and outputting a filtered signal based on the moving average;

further comprising the steps of:

suspending the calculating step if the pedal input signal corresponds to an invalid signal, wherein an invalid signal is either below an idle pedal signal or above a maximum throttle signal; and outputting an unfiltered pedal input signal.

11. The method of claim 10, wherein the suspending step is performed only if the invalid signal is present for at least 50 ms.

12. The method of claim 10, further comprising the step of:

reengaging the calculating step if the pedal input signal is not an invalid signal for at least one period of the targeted frequency.

13. A throttle filter system, the system comprising:

a pedal configured to be actuated to set a desired acceleration of a vehicle;

a position sensor configured to convert a position of the pedal into an electrical signal;

a vehicle driveline configured to accelerate the vehicle; and a filtering module configured to accept the electrical signal from the position sensor and to filter the electrical signal to remove oscillations at a targeted frequency; and wherein the driveline accelerates the vehicle based on the filtered electrical signal.

14. The throttle filter system of claim 13, wherein the targeted frequency is a beaming frequency of a vehicle frame.

15. The throttle filter system of claim 13, wherein the targeted frequency is from 2 to 10 Hz.

16. The throttle filter system of claim 13, further comprising an engine control module, wherein the filtering module outputs the filtered electrical signal to the engine control module and wherein the engine control module outputs the filtered electrical signal to the driveline.

17. A control device configured to receive a first signal that corresponds to a position of a pedal and to output a second signal that commands a driveline of a vehicle, the control device comprising:

a filtering module configured to sample the first signal at a sampling frequency and output a moving average of the first signal as the second signal such that oscillations of a targeted frequency are filtered from the first signal.

18. The control device of claim 17, wherein the targeted frequency is a beaming frequency of a frame of the vehicle.

19. The control device of claim 17, wherein the targeted frequency is from 2 to 10 Hz.

20. The control device of claim 17, wherein the filtering module calculates the moving average at the sampling frequency.

21. The control device of claim 17, wherein the sampling frequency is between 100 and 1000 Hz.

* * * * *